United States Patent [19]

Robinson

[11] 4,063,736

[45] Dec. 20, 1977

[54] PUZZLE APPARATUS

[76] Inventor: Alexander Kennedy Robinson, Windyridge, 40 Nursery Lane, Moortown, Leeds, Yorkshire, England

[21] Appl. No.: 742,695

[22] Filed: Nov. 17, 1976

Related U.S. Application Data

[63] Continuation-in-part of Ser. No. 583,706, June 4, 1975, abandoned.

[51] Int. Cl.[2] ..... A63F 9/10

[52] U.S. Cl. ..... 273/157 R; 35/27; 273/137 D; 428/33

[58] Field of Search ..... 273/156, 157 R, 137 D; 35/27; D34/15 M; 428/33

[56] References Cited

U.S. PATENT DOCUMENTS

| | | | |
|---|---|---|---|
| 1,087,207 | 2/1914 | Austin | 273/137 D UX |
| 3,295,228 | 1/1967 | Turnbull | 35/27 |

FOREIGN PATENT DOCUMENTS

| | | | |
|---|---|---|---|
| 1,965,158 | 6/1971 | Germany | 35/27 |

OTHER PUBLICATIONS

"Polyominoes" by S. W. Golomb, published by Charles Scribner's Sons, New York, 1965, pp. 132–134.

"New Mathematical Pastimes" by P. A. MacMahon, published by Cambridge University Press, London, 1921, pp. 50–57.

*Primary Examiner*—Anton O. Oechsle

*Attorney, Agent, or Firm*—Wolf, Greenfield & Sacks

[57] ABSTRACT

Puzzle apparatus comprising a plurality of planar pieces, each piece having a shape and a color pattern corresponding to a portion of master pattern which comprises a grid of regular rhomboidal cells, the puzzle application being to arrange the pieces in conformity with the color pattern so as to form a complete assembly which encloses no empty cells and which in itself is a repeating unit of the master pattern.

7 Claims, 19 Drawing Figures

PUZZLE APPARATUS

This application is a continuation in part of my copending application Ser. No. 583,706, filed June 4, 1975, and now abandoned.

This invention relates to what may broadly be termed puzzle apparatus, but which also provides a comprehensive and versatile system of inter-related parts applicable in a number of different fields and in particular the fields of pattern making, board games, educational equipment, aptitude and intelligence test, mathematical recreations and problems and amusements of the tangram type.

The invention has different facets related to the fields quoted above, and it embodies a large number and variety of inter-related flat geometrical shapes, but the common factor is the use of a particular master pattern consisting of a grid pattern which decides the possible shapes and a color applied to the grid pattern.

According to the present invention there is provided puzzle apparatus comprising a set of 48 or a multiple of 48 pieces, each piece being planar and having a shape, and on at least one face a color pattern, corresponding respectively to the shape and color pattern of seven contiguous rhomboidal cells from a master pattern which in the case of simple rectilinear cells may be constructed by overlapping a first regular hexagonal mesh by three identical hexagonal meshes so as to partition the hexagons of the first mesh into 12 identical rhomboidal cells and in which in the same case three lines or chains of similarly oriented cells intersect at the centre of said hexagons, neighboring cells in each line having different colors and alternate cells in each line having similar color, each of the three lines of cells presenting a different pair of colors from the other lines, and cells of a similar color in parallel lines being in staggered or zigzag relationship one to another, the master pattern in other cases comprising cells derived from the rectilinear cells aforesaid by similarly treating each of the sides thereof, the pieces being arrangeable to provide a continuous planar assembly conforming with the master pattern.

Embodiments of the invention will now be described by way of example and with reference to the accompanying drawings, of which:

Figure 1A:
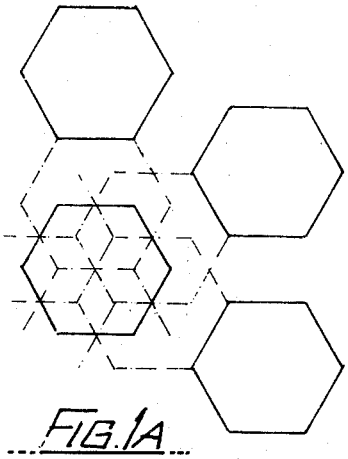
FIG. 1A illustrates the formation of the grid pattern.

The grid pattern is obtained by superimposing and positioning on a first regular hexagonal network three identical hexagonal networks with the sides of their component hexagons parallel and the hexagons overlapping so that centrally on the three diametrical lines drawn between opposing corners of a hexagon of the first network lies a side of a hexagon of each of the other three networks respectively, resulting in the division of each hexagon of the first network into twelve equal rhomboidal cells. The relation between the four networks is shown in FIG. 1A which shows in full line one hexagon from each network. Thus if on the lower left hexagon as shown is superimposed hexagons of the networks extending from each of the other hexagons shown in full lines in the Figure, the cell structure shown in broken lines is presented.

Figure 2:
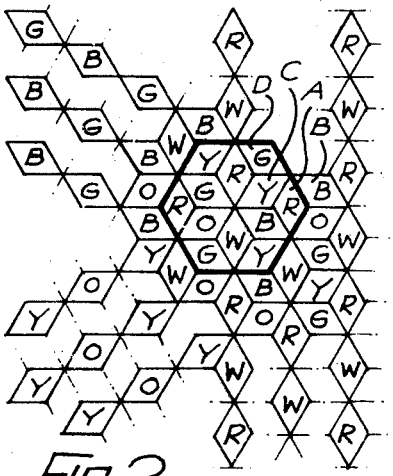
FIG. 2 illustrates the formation of the color pattern.

The color pattern employs six colors and is designed to repeat in units of 48 cells. This repetition is obtained by using the six colors in three pairs in the three lines or chains of similarly oriented cells provided by the grid. These lines intersect one with another at 60° at the center of each 12-cell hexagon as shown in FIG. 2. The colors of each pair alternate in the line as indicated by the code letter of which, in this example, G represents Green
B represents Blue
Y represents Yellow
R represents Red
O represents Orange and
W represents White.

Cells having similar color in neighboring parallel lines are arranged in staggered or zigzag relationship one to the other as shown by the arrangement of white cells in the vertical lines in FIG. 2.

Figure 1B:
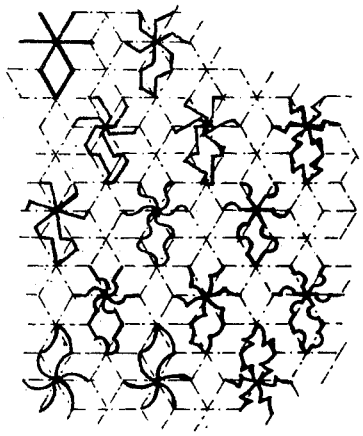
FIG. 1B shows the extension of the grid from rectilinear to curvilinear cells.

For the most part in this specification the rhomboibal cells are give their simplest form, in which the sides are rectilinear, but this is not an essential condition. The cell structure can be represented by lines which radiate at 60° intervals from the centers and from the mid points of the sides of the hexagons of each network. Each cell is produced by the inter-section of two pairs of these lines. So long as all the lines are treated similarly, they can be given any shape that does not involve interference between sides. FIG. 1B shows thirteen simple treatments of the sides and how in each case a cell is formed. These cells are not, like the rectilinear cells, identical with their mirror images, but the curvilinear cells are compatible with one another as can be seen from FIGS. 13A and 13B.

The invention uses three broad groups of components namely main pieces, boards, and accessories.

Figure 3A:
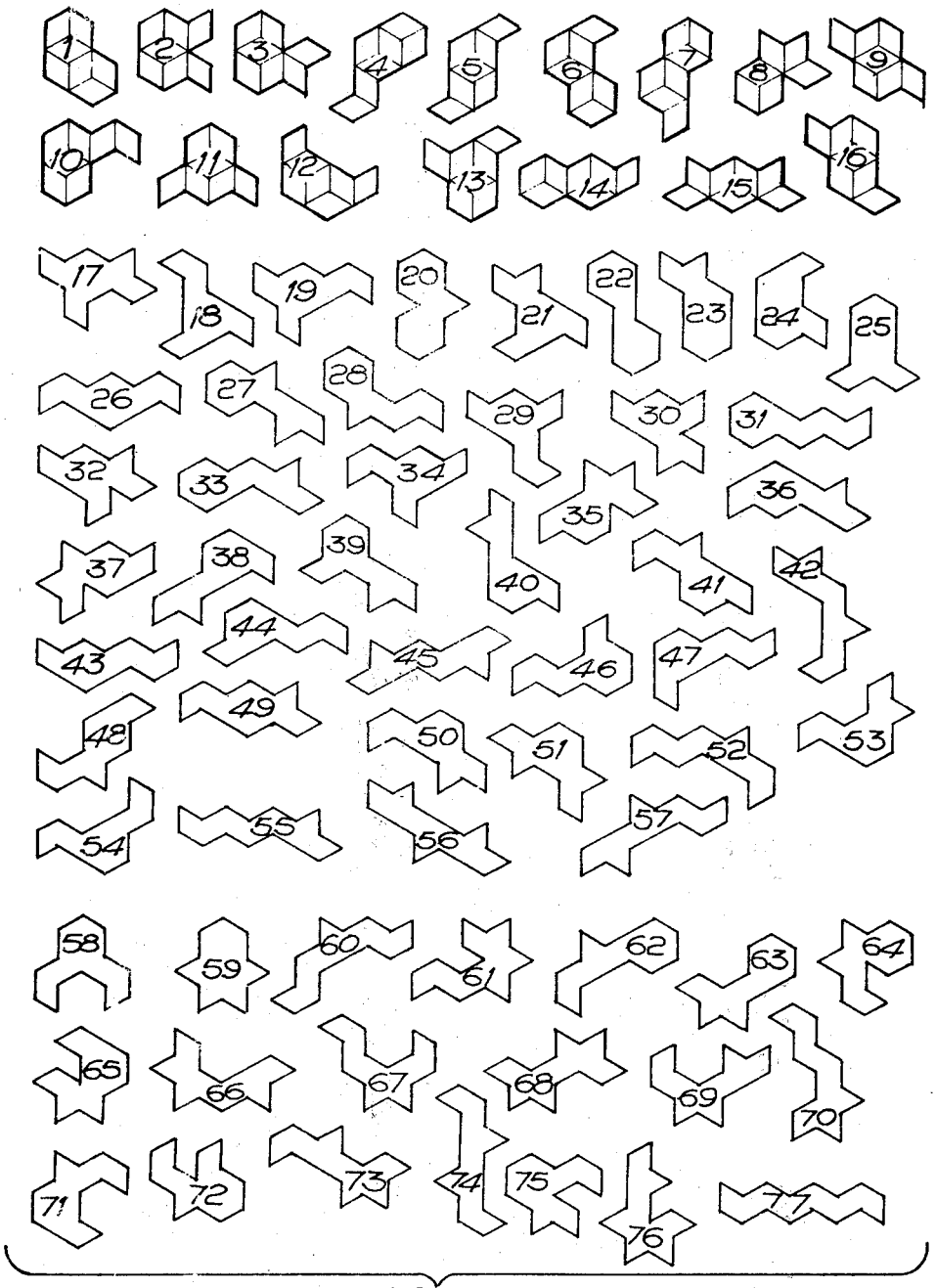
FIG. 3A shows the 77 different shapes in which the pieces can be formed.
Figure 3B:
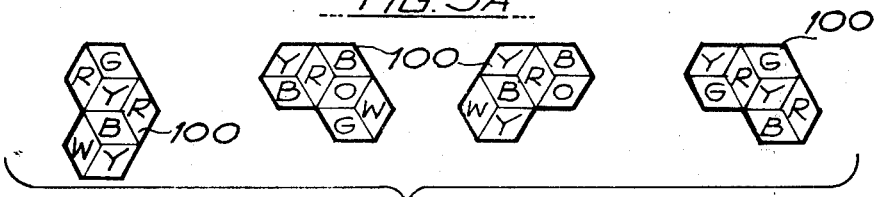
FIG. 3B shows a single shape from FIG. 3A in a plurality of color arrangements.

The main pieces are formed from seven contiguous cells of the master pattern, that is to say the grid pattern on which is superimposed the color pattern, and thus are referred to as pieces-of-seven. FIG. 3A shows the different shapes of pieces-of-seven, numbered 1 to 77 which can be produced from the grid pattern without including mirror images. Each of the pieces can be obtained in a different color arrangement depending upon the portion of the master pattern which the piece was derived. Thus FIG. 3B shows pieces-of-seven of shape 1 (see FIG. 3A) in four of the different color arrangements that can be found in the master pattern.

The examples are compatible with cell 100 being identified respectively with cells A, B, C, and D of FIG. 2.

The primary puzzle application of the invention comprises fitting a plurality of pieces together into a continuous assembly, that is to say without empty cells between them, in full accordance with the master pattern. The preferred objective is to produce an assembly which is in itself a repeatable unit, that is to say if it is joined to similar assemblies the combined assemblies would still conform with the master pattern, without empty cells between them.

Because seven is a prime number and not a factor of 48, any group or combination of pieces-of-seven that can be formed into a continuous assembly maintaining the color pattern in all directions must consist of 48 or a multiple of 48 pieces. Sets of 48 pieces-of-seven differing in color arrangement are thus a major feature, and in fact may be regarded as the backbone of the system.

Figure 5:
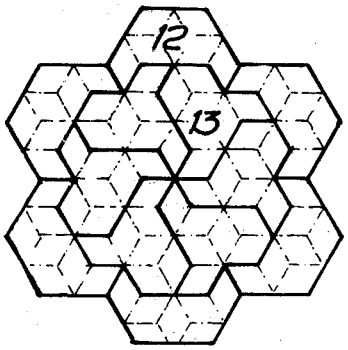
FIG. 5 shows an assembly comprising six pieces of each of two shapes.
Figure 9:
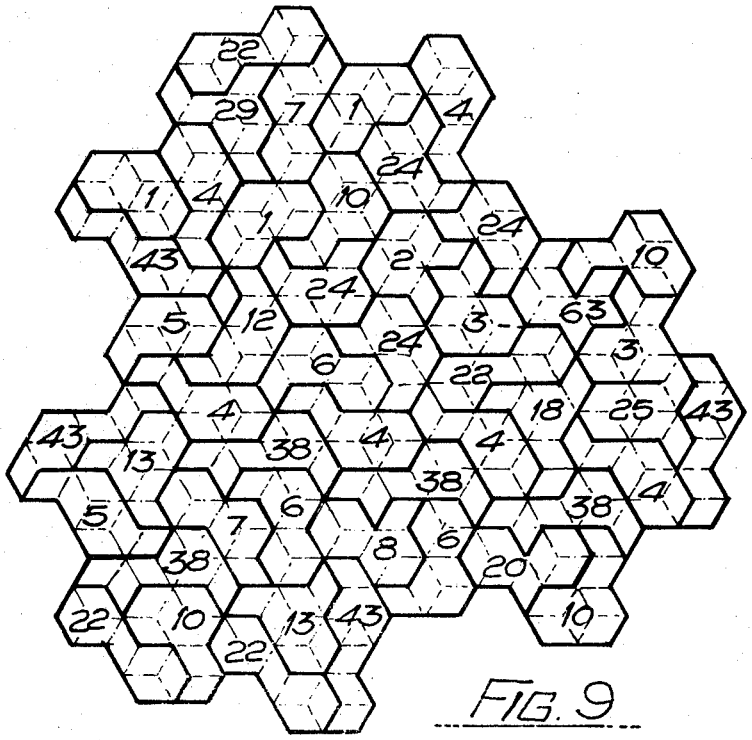
FIG. 9 shows a continuous assembly of 48 pieces each having seven cells.
Figure 12:
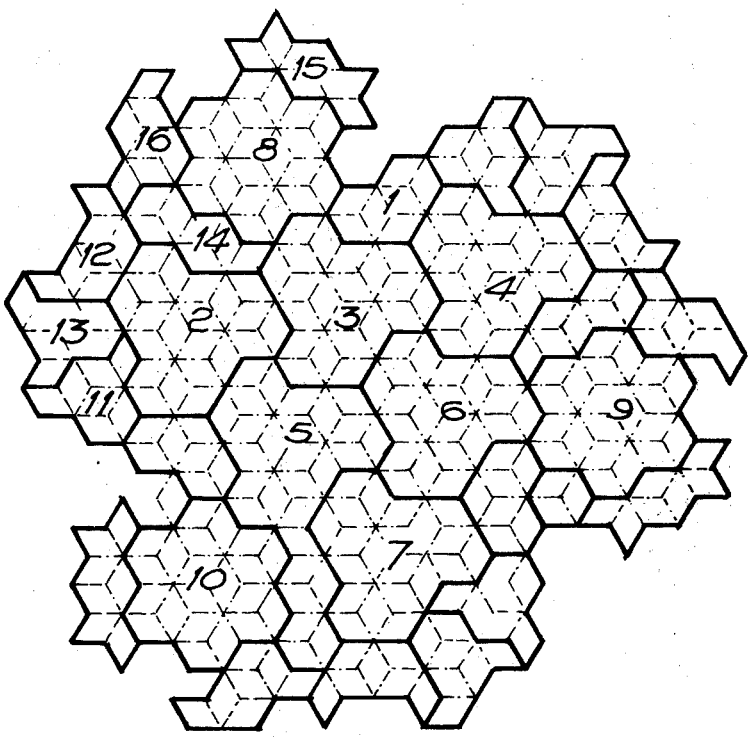
FIG. 12 shows an assembly of 48 pieces.

Sixteen of the seventy-seven shapes can be formed into continuous patterns comprising a single shape, but the scope of the system is increased by the large number of ways in which the pieces-of-seven can be paired or grouped to make complete assemblies of 48. FIG. 5 is an example of an incomplete assembly of paired pieces. An example of 48 pieces-of-seven assembled into a repeating unit is shown in FIG. 9 in which the numbers refer to the shape numbers defined by FIG. 3A. Another set of 48 pieces is shown in FIG. 12 which consists of three each of the shapes numeral 1 to numeral 16. The assembly of pieces as shown in FIG. 12 is not a repeating unit, and the problem in the primary puzzle application is to find an assembly that is a repeating unit.

A repeating assembly of 48 pieces has no fixed shape; the outline is fluid within a wide range because any piece or group of pieces on the edge of the assembly can be moved to alternative positions on other edges. Moreover the usual aids to solving jigsaw puzzles such as odd bits of shape or color are not available. The required piece for a particular position must be deduced from studying the pattern. Familiarity with the pieces, which limits the continued interest of any ordinary jigsaw, is no help in these, and each reshuffle means a fresh start without the aid of remembered associations or of recognisable edges.

Whilst it is primarily envisaged that the puzzle will be attempted by one person, it could possibly be used as the basis for a game between two or more players.

In an alternative application, the pieces may be used in pattern designing. For this purpose they are made reversible, the reverse carrying the grid pattern but being in a single color and a set for example eight pieces in each of six different colors.

As has already been stated, a puzzle set comprises 48 or a multiple of 48 pieces-of-seven. Although only 16 sets can be produced wherein each piece-of-seven is of identical shape if the set is to be capable of arrangement into a repetition unit, further sets can be provided by including in them two or three shapes. Still further sets can be provided by using the mirror images of the non-symmetrical shapes in FIG. 3A. Further sets still can be provided by changing the pairing of the colors in the color pattern. Thus whilst limiting the system to rectilinear cells a very large number of different sets can be produced, and each set constitutes a different puzzle but having the same objective. By extending the system to the use of curvilinear cells, the number of different sets is of course vastly increased.

Figure 8A:
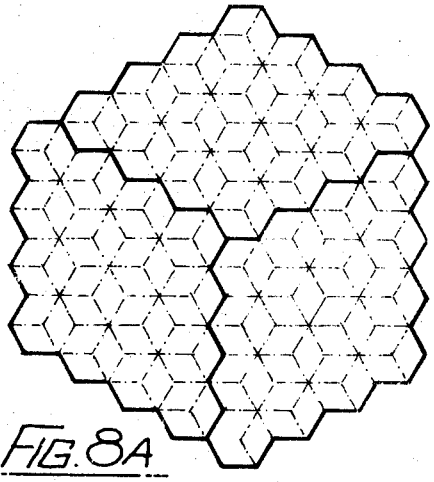
FIG. 8A shows an assembly of three unit boards of similar shape.
Figure 8B:
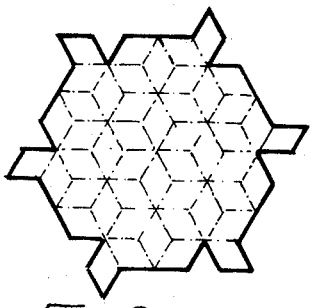
FIGS. 8B, 8C and 8D show unit boards of different shapes.
Figure 8C:
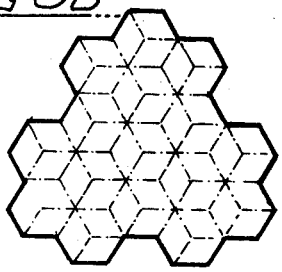
Figure 8D:
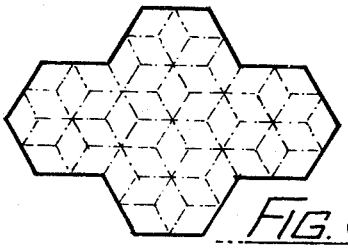

In a preferred embodiment the invention also utilises boards on which the pieces may be assembled. They are double-sided, bearing the full master pattern on one side and only the grid pattern on the other. They have a pattern of shallow bosses at the centre of the constituent cells to correspond with matching depressions in the pieces-of-seven. A unit board may correspond to 48 cells of the master pattern as shown in FIGS. 8B, 8C and 8D. A plurality of unit boards may be assembled together as shown in FIG. 8A to provide a surface large enough for assembling the pieces-of-seven. Typically more than seven unit boards of this size will be put together to accommodate a full set of 48 pieces and to allow an adequate margin. The flexibility of the arrangement of unit boards allows for the development of the growing assembly in a different manner from that expected when the puzzle was begun, that is to say a unit board can be moved from one position where it is not needed to another position where it is needed during the course of doing the puzzle. Rectangular boards of suitable size and having the full master pattern on one side and grid pattern on the other may also be provided.

Whilst the primary purpose of the boards is to provide an assembly board for pieces-of-seven, they may also be used in association with the minor pieces to be described below.

Figure 6:
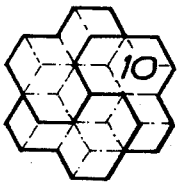
FIG. 6 shows a common outline for shapes 1, 8, 9 and 10.
Figure 13A:
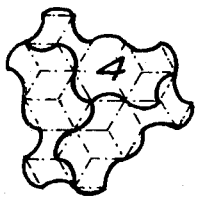
FIGS. 13A and 13B show groups of three seven-cell units of which the component cells are curvilinear.
Figure 13B:
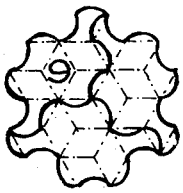

Accessory pieces may be used in conjunction with the pieces-of-seven as already described. Thus it is frequently found that in the primary puzzle application of the pieces, the pieces-of-seven are grouped together in threes, known as tri-sevens of which one is shown in FIG. 6 and curvilinear tri-sevens are shown in FIGS. 13A and 13B. Major pieces may therefore be formed which have the outline and color arrangement of tri-sevens, of which sixteen comprise a set arrangeable into a complete repeating assembly.

Because of the number of pieces in a set of tri-sevens is smaller, the problem of arranging them is less demanding and the puzzle can be regarded as an easy introduction to the primary puzzle. Moreover, when the problem of putting the 16 tri-sevens together has been mastered, each tri-seven may, if it is made of suitable material, be cut into three pieces-of-seven so that a standard set of 48 pieces-of-seven is produced. Some tri-sevens can be cut in different ways to produce three identical pieces-of-seven; thus the tri-seven shown in FIG. 6, although shown as comprising three pieces of shape 10, could equally be divided into three pieces each of either shape 1, shape 8 or shape 9.

Figure 4:
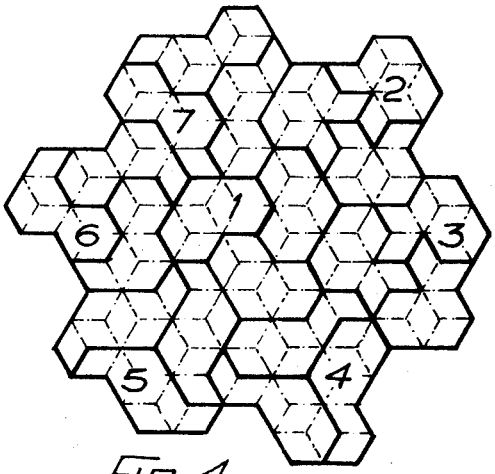
FIG. 4 is an arrangement of the first seven shapes in threes.
Figure 10:
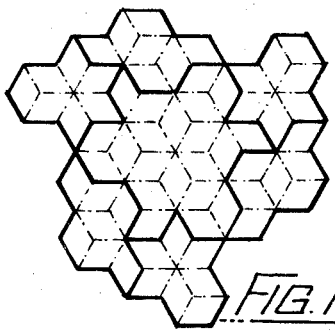
FIG. 10 shows a continuous assembly comprising nine pieces.
Figure 11:
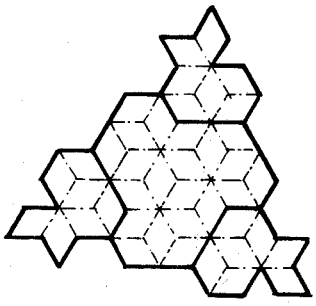
FIG. 11 shows a continous assembly comprising six pieces.

FIG. 9 shows a repeating assembly of 48 pieces-of-seven which could be produced from 16 identical tri-sevens. FIG. 4 shows an assembly using seven identical tri-sevens; further pieces need to be added to it to make it into a full repeating assembly equivalent to 48 pieces-of-seven. FIGS. 10 and 11 each show a small assembly combining a tri-seven with a plurality of pieces-of-seven.

Other major pieces comprise pieces-of-seven combined in pairs.

Minor pieces comprising six of fewer contiguous cells from the master pattern can be used as packing pieces and may be particularly useful in the application of the invention to pattern designing.

Figure 7:
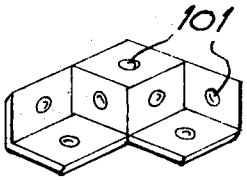
FIG. 7 is a perspective view of a piece of shape 1.

The pieces, whether they be pieces-of-seven, major pieces or minor pieces may be formed of fibreboard, cardboard, wood plastics or other suitable material. If produced from a thick material they may have depressions at the centers of the cells on one or both faces to correspond with the bosses on the boards as described. If the pieces are to be used for pattern making, the color pattern will be confined to one face only of each piece and the other face will be self-colored. For the puzzle application, the master pattern will appear on both faces. FIG. 7 shows a piece of shape 1 constructed in ply-wood and shows depressions 101 at the centers of the cells.

The invention also envisages blanks or portions of planar material bearing on at least one face the master pattern as aforesaid, the blanks being for cutting to form pieces-of-seven or other pieces such as tri-sevens therefrom.

The invention provides equipment intended to be used in a wide variety of ways and makes possible many new developments in well established fields. Some examples are listed below.

1. It introduces variable layout board games of which the size, shape and overall pattern can be altered as required.

2. It produces a vast range of geometric puzzles, many of which consist of not more than two shapes but whereof the solutions depend on the recognition of the underlying pattern of a first piece and deducing from it the pattern of a second piece required to fit adjacent to it.

3. In conjuction with the boards these puzzles can be turned into competitive board games.

4. It extends shape and color pattern into the domino field in a way differing materially from previous invention in the field.

5. It greatly enlarges the field of games of the draughts or chess type by the use of a six-color three-direction board instead of a two-color checker pattern. Further variations may be introduced by using selected pieces-of-seven or auxiliary pieces of other sizes and shapes in conjunction with color, and by widening the range of controlled movement, not only in translation but in two other modes, namely rotation around a point or cell and turning pieces over by rolling over one of their edges.

6. It opens up a new range of problems in the field of mathematical problems and recreations.

7. It provides a means of systematically developing complex geometrical patterns by a stage-by-stage process from simple patterns.

8. The pieces-of-seven, particularly in sets of mixed pieces and ignoring the color pattern, can be used as a variation of tangrams, in which they are used to make silhouette images or pictures, but more difficult than tangrams because of the absence of smaller pieces.

9. The puzzles can be used very effectively in a variety of ways as intelligence, recognition and aptitude tests. For instance several pieces may be interchanged in a laid-out set, and the test could be to rectify the errors.

10. In addition to the considerable educational value of the above examples, the sets of component parts make a very good educational toy, the process of trying to find all the possible different pieces-of-seven, involving a good deal of analysis and reasoning as well as recognition.

I claim:

1. Puzzle apparatus comprising a set of 48 or a multiple of 48 pieces, each piece being planar and having a shape, and on at least one face a color pattern, corresponding respectively to the shape and color pattern of seven contiguous rhomboidal cells from a master pattern which in the case of simple rectilinear cells may be constructed by overlapping a first regular hexagonal mesh by three identical hexagonal meshes so as to partition the hexagons of the first mesh into twelve identical rhomboidal cells and in which in the same case three lines or chains of similarly oriented cells intersect at the centre of said hexagons, neighboring cells in each line having different colors and alternate cells in each line having similar color, each of the three lines of cells presenting a different pair of colors from the other lines, and cells of similar color in parallel lines being in staggered or zigzag relationship one to another, the master pattern in other cases comprising cells derived from the rectilinear cells aforesaid by similarly treating each of the sides thereof, the pieces being arrangeable to provide a continuous planar assembly conforming with the master pattern.

2. Puzzle apparatus according to claim 1, wherein the 48 or 48 of the pieces have the same shape but present different color arrangements.

3. Puzzle apparatus according to claim 1, wherein the set comprises pieces of different shape.

4. Puzzle apparatus according to claim 1, wherein one face of each of the pieces is wholly of one color, the color of the face of one piece differing from the color of the face of another piece.

5. Puzzle apparatus according to claim 1, further comprising a games board having at least one of its faces marked with the master pattern of rhomboidal cells whereby the pieces can be arranged on the board to conform with the shape and color of the cells of the master pattern on the board.

6. Puzzle apparatus according to claim 1, further comprising a plurality of accessory pieces, each accessory piece being planar and having a shape consisting of six or less of the rhomboidal cells from the master pattern, and the accessory pieces being adapted for use in association with the first-mentioned pieces.

7. Puzzle apparatus according to claim 1, further comprising a plurality of accessory pieces, each accessory piece being planar and having a shape consisting of a multiple of seven contiguous rhomboidal cells from the master pattern, and the accessory pieces being adapted for use in association with the first-mentioned pieces.

* * * * *